United States Patent [19]
Ludwig

[11] 4,189,981
[45] Feb. 26, 1980

[54] COMBINATION THROTTLE KICKER AND DECELERATION VALVE

[75] Inventor: George C. Ludwig, Owosso, Mich.

[73] Assignee: Tom McGuane Industries, Inc., Madison Heights, Mich.

[21] Appl. No.: 865,983

[22] Filed: Dec. 30, 1977

[51] Int. Cl.² ..... F15B 13/042
[52] U.S. Cl. ..... 91/52; 91/461
[58] Field of Search ..... 91/52, 461, 416; 123/103 R

[56] References Cited

U.S. PATENT DOCUMENTS

| | | | |
|---|---|---|---|
| 3,028,847 | 4/1962 | Sterner | 91/52 X |
| 3,072,111 | 1/1963 | Cramer | 123/103 R |
| 3,448,659 | 6/1969 | Beatenbough et al. | 91/52 X |
| 3,483,800 | 12/1969 | Golden | 92/98 R |
| 3,486,416 | 12/1969 | Eastman | 91/461 X |
| 3,502,000 | 3/1970 | Voges et al. | 123/103 R |
| 3,517,588 | 6/1970 | Kytta | 92/48 X |

*Primary Examiner*—Irwin C. Cohen
*Attorney, Agent, or Firm*—Barnes, Kisselle, Raisch & Choate

[57] ABSTRACT

A combination throttle kicker and deceleration valve comprising a housing, and a wall dividing the housing. A first diaphragm is provided on one side of the said housing is adapted to engage said wall and prevent the flow of air through an opening in the wall. A second diaphragm is provided on the other side of the said wall, and has an orifice therein. A shaft is adapted to be moved by the second diaphragm upon movement of the second diaphragm away from the wall. The shaft extends exteriorly and is adapted to be linked to a throttle. Passages provide communication between the chambers formed by the diaphragms and the ends of the housing.

10 Claims, 12 Drawing Figures

FIG. 1
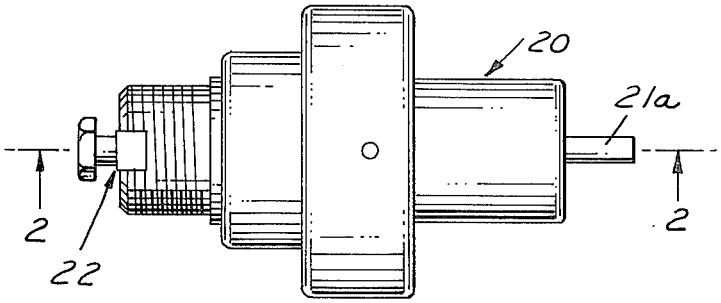
FIG. 2
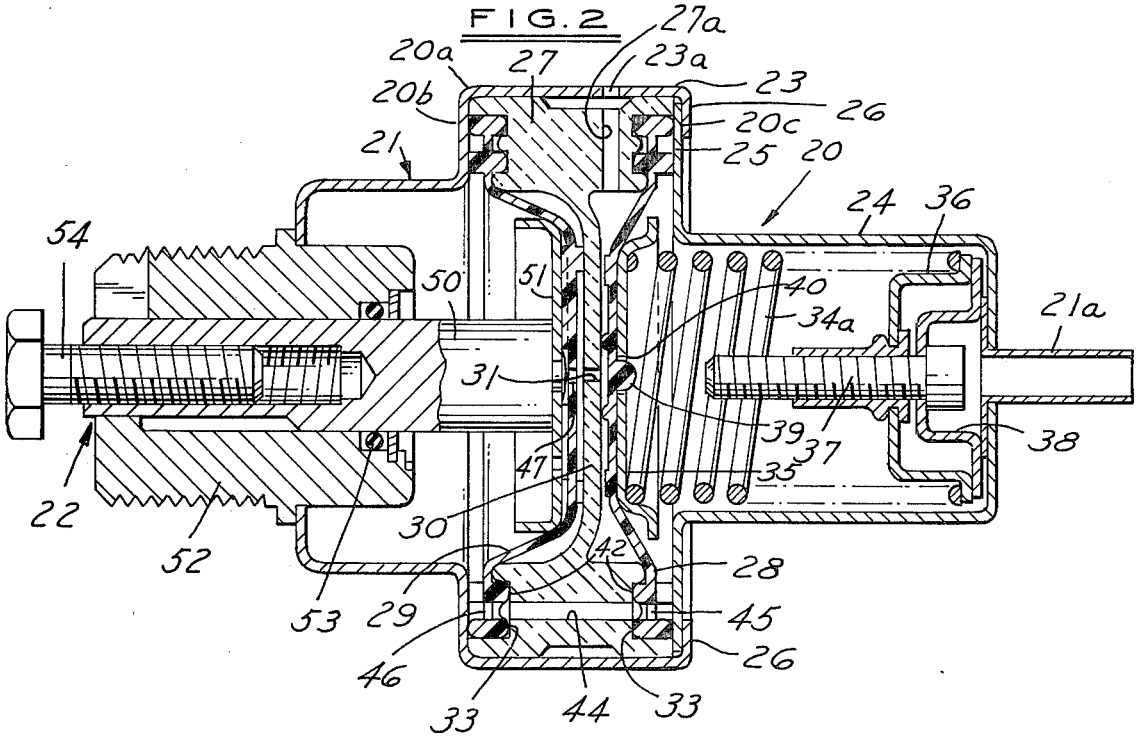
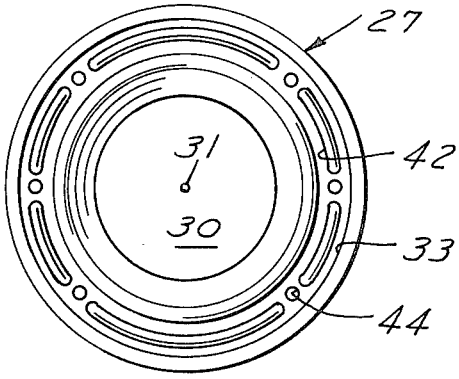
FIG. 3

COMBINATION THROTTLE KICKER AND DECELERATION VALVE

This invention relates to throttle kickers and deceleration valves which are utilized in connection with automotive engines and the like.

BACKGROUND AND SUMMARY OF THE INVENTION

In controlling emissions of automotive engines, it has been determined that excessive emissions occur during deceleration. One of the methods utilized to minimize the emissions during decelerations is to increase the throttle position thereby making the inherently rich idle mixture lean and maintaining combustion within the engine cylinders. Heretofore, such a system has required a separate valve for sensing deceleration and an actuator for providing a movement to the throttle.

Among the objects of the invention are to provide a combination throttle kicker and decleration valve which would effectively function to control the position of the throttle, which is compact, relatively low in cost and performs the desired functions efficiently.

Basically, the throttle kicker embodying the invention comprises a housing, a wall dividing the housing, a first diaphragm on one side of the said housing, and a diaphragm adapted to engage said wall and prevent the flow of air through an opening in the wall. A second diaphragm is provided on the other side of the said wall and has an orifice therein. A shaft is adapted to be moved by the second diaphragm upon movement of the second diaphragm away from the wall. The shaft extends exteriorly and is adapted to be linked to a throttle. Means are provided for communication between the chambers formed by the diaphragms and the ends of the housing.

DESCRIPTION OF THE DRAWINGS

FIG. 1 is a side elevational view of a combination throttle kicker and deceleration valve embodying the invention;

FIG. 2 is a sectional view on an enlarged scale taken along the line 2—2 in FIG. 1;

FIG. 3 is a side elevational view of a part of the valve;

DESCRIPTION

Figure 4:
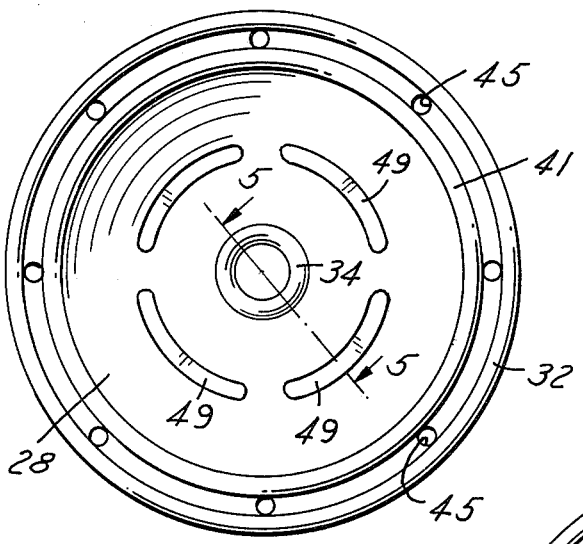
FIG. 4 is a side elevational view of one of the diaphragms in the valve.
Figure 5:
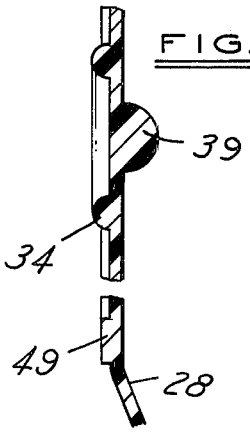
FIG. 5 is a fragmentary sectional view on an enlarged scale taken along the line 5—5 in FIG. 4.
Figure 6:
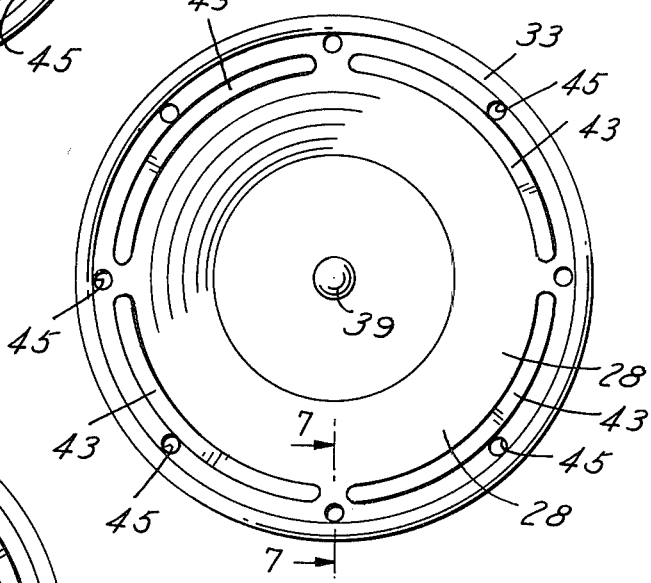
FIG. 6 is a side elevational view of the opposite side of the diaphragm shown in FIG. 4.

Referring to FIGS. 1 and 2, the combination throttle kicker and deceleration valve embodying the invention comprises a metal housing 20 which at one end has a connection 21*a* to vacuum and at the other end includes a shaft 22 that is adapted to be connected to a throttle for advancing the throttle.

As shown in FIG. 2, the housing 20 includes a body 21 that has a central portion 23 of greater diameter and a cover 24 having a radially extending wall 25 over which portion 26 of the body 21 is bent or crimped. The assembled housing thus in effect has a central portion 20*a* of greater diameter with radial side walls 20*b*, 20*c*. An annular adapter 27 of plastic material such as glass fiber reinforced nylon is positioned in the portion of enlarged diameter and holds a first diaphragm 28 and a second diaphragm 29 in position. The adapter 27 includes a central wall 30 having an opening 31. The diaphragms are made of a flexible material such as a knitted polyester fabric impregnated with epichlorohydrim.

Referring to FIGS. 4–9 each of the diaphragms 28, 29 includes an annular rib 32 at its outer periphery that extends axially in each direction and engages the side wall 20*b*, 20*c* of the housing as well as groove 33 in each surface of the adapter 27. The diaphragm 28 further includes an annular rib 34 that seals against one surface of the wall 30 to prevent venting from passage 23*a* being applied to the opening 31 through passage 27*a* in adapter 27. A spring 34*a* is interposed between a washer 35 and an adjustment washer 36 to yieldingly urge the diaphragm 28 against the wall 30. A bolt 37 is threaded into washer 36 so that the position of the inner end of said bolt can be adjusted to vary the preload on the spring 34*a* and therefore control the movement of the diaphragm 28 away from wall 30. An enlargement 39 extends axially from the outer surface of the diaphragm 28 into an opening 40 in the washer 35 to align the washer 35 relative to the diaphragm 28.

Figure 7:
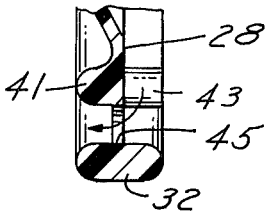
FIG. 7 is a fragmentary sectional view on an enlarged scale taken along the line 7—7 in FIG. 6.
Figure 8:
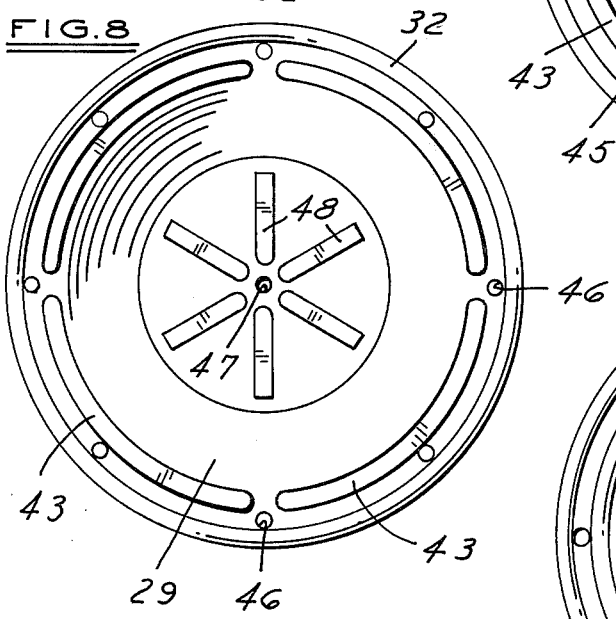
FIG. 8 is a side elevational view of the other diaphragm in the valve.
Figure 9:
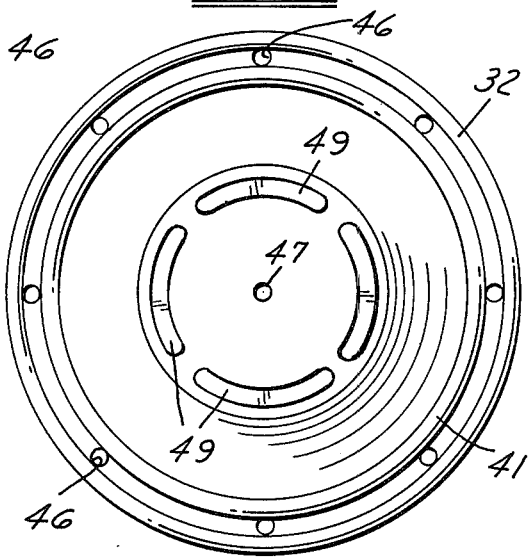
FIG. 9 is a side elevational view of the opposite side of the diaphragm shown in FIG. 8.

Each diaphragm 28,29 further includes a second annular rib 41 on one surface thereof extending axially into a second groove 42 in the adapter 27 and spaced radially inwardly from rib 32 thereon (FIGS. 4,7).

Each diaphragm 28,29 further includes a plurality of arcuate circumferentially spaced ribs 43 on the other surface thereof that extend toward the side walls of the housing and thereby provide communication, as presently described. The adapter 27 includes circumferentially spaced axial openings 44 that communicate with openings 45,46 in the diaphragms 28,29 so that there can be a free flow of vacuum from port 21*a* between the chambers.

The diaphragm 29 further includes an orifice 47. The orifice is normally held in spaced relationship to the wall 30 by the radial spacer ribs 48.

Finally, each diaphragm 28,29 includes arcuate spacer ribs 49.

Diaphragm 29 is adapted to move the throttle kicker 22 through a shaft 50 which includes a portion which is non-circular in cross section and cooperates with a portion of a fitting 52 to prevent rotation of shaft 50. The shaft 50 is connected to a washer 51 that engages the outer surface of the diaphragm 29. Shaft 50 is slidable in a fitting 52 in the housing 21. An O-ring 53 provides a seal between the shaft 50 and the fitting 52. A bolt 54 is threaded in the shaft to provide adjustment. During adjustment, the shaft 50 is prevented from rotating by fitting 52.

During normal engine operation, when the vacuum is below the calibration value, the vent valve remains closed and vacuum is applied to the throttle kicker and equalizes to the opposite side of the diaphragm through the orifice. Such there is no differential vacuum across the diaphragm there is a resultant force equal to the applied vacuum applied to the area of shaft 50 and the kicker remains retracted. During a deceleration mode manifold vacuum is greater than the calibration value thereby moving diaphragm 28 and uncovering opening 31 and venting the retraction side of the throttle kicker diaphragm allowing the existing vacuum to extend the kicker shaft 22 by moving diaphragm 29. When the manifold drops below the calibration value opening 31 is closed thereby allowing the orifice 47 to equalize the vacuum across the throttle kicker diaphragm 29 and permitting the differential pressure on shaft 50 to retract the kicker shaft 22.

Figure 10:
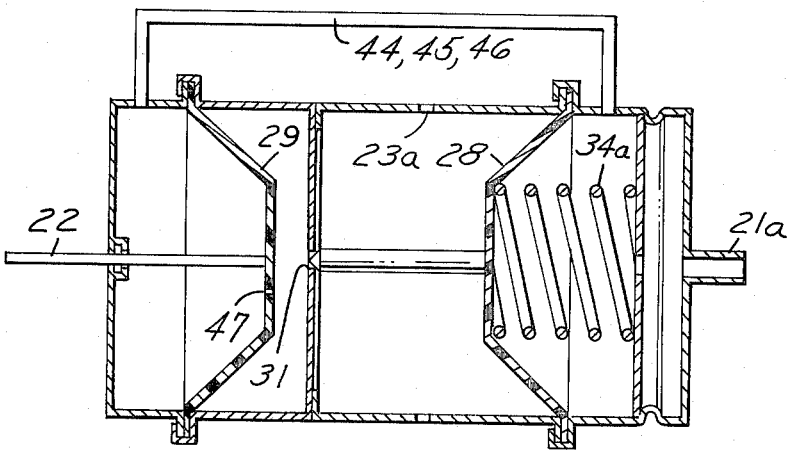
FIGS. 10, 11 and 12 are diagrammatic views showing the operation of the valve.
Figure 11:
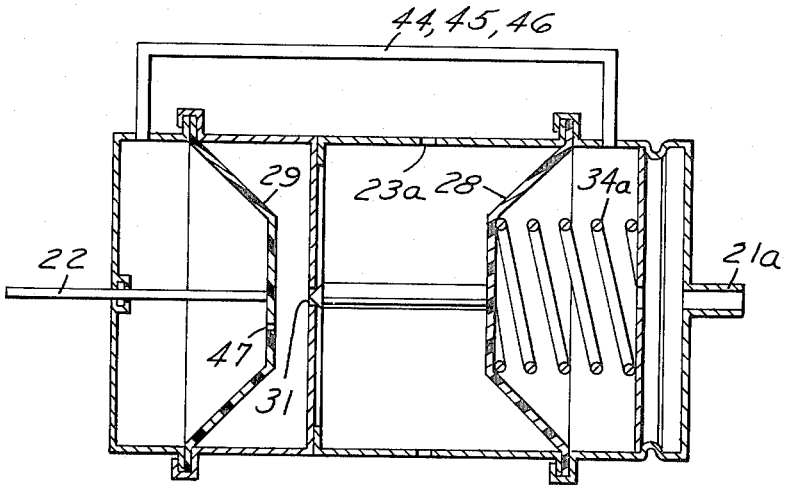
Figure 12:
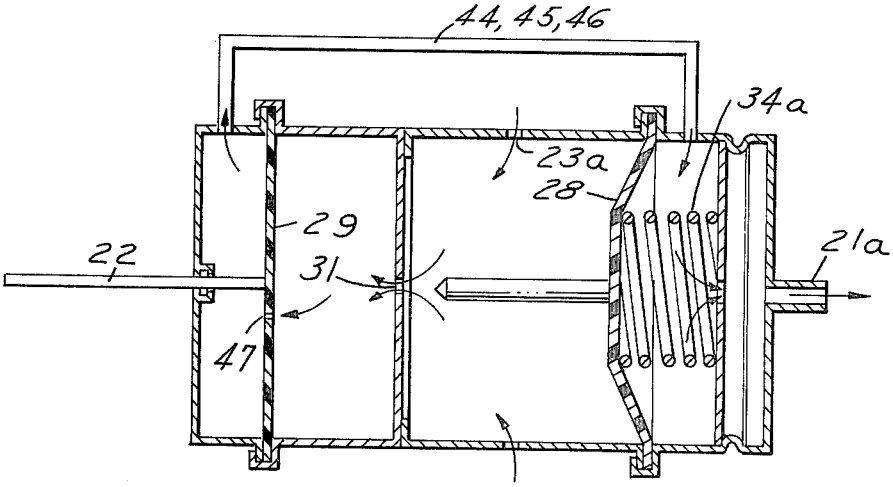

The operation of the valve embodying the invention can be understood by reference to the schematic drawings FIGS. 10, 11 and 12, wherein identical reference numerals are utilized for clarity.

During normal engine operation, where the vacuum is below the calibration value, the valve orifice 31 remains closed and vacuum equalizes through the passage 44, 45, 46 and 47 (FIG. 10). Similarly, the orifice 31 remains closed when there is no vacuum. During a deceleration mode, manifold vacuum greater than the calibration value is applied thereby causing diaphragm 28 to move to open orifice 31 to allow the vacuum to extend the throttle kicker 22. When the manifold vacuum drops below the calibration value, the spring 34*a* closes the orifice 31 thereby allowing the vacuum to equalize through orifice 47 permitting diaphragm 29 to return the throttle kicker 22.

I claim:

1. A combination throttle kicker and deceleration device comprising a housing, a wall dividing said housing, a first diaphragm on one side of said wall forming a chamber with an end of said housing, said housing having a connection for connecting the chamber between said first diaphragm and said housing to vacuum, said wall having an opening therein providing communication between the two sides of said wall, means defining a vent passage from the space between said first diaphragm and said wall to the ambient atmosphere exterior of said housing, said diaphragm being adapted to engage said wall and prevent the flow of air through the opening in said wall, spring means yieldingly urging said first diaphragm toward said wall, a second diaphragm on the other side of said wall forming a chamber with an end of said housing, means defining an orifice in said second diaphragm providing free access of air between said second diaphragm chamber and said wall, and a shaft adapted to be moved by said second diaphragm upon movement away from said wall, said shaft extending exteriorly and being adapted to be linked to a throttle, and means providing communication between the chambers formed between the diaphragms and the ends of the housing.

2. The combination set forth in claim 1 wherein said last-mentioned means providing communication comprises passages in said diaphragms and means providing direct communication between said passages.

3. The combination set forth in claim 1 wherein said last-mentioned means comprises an annular member interposed between the peripheries of said diaphragms, said member having at least one opening extending axially therethrough, said diaphragms having passages aligned with said openings and communicating with said chambers.

4. The combination set forth in claim 3 wherein said annular member includes at least one passage extending to the vent passage communicating with the ambient atmosphere.

5. The combination set forth in claim 1 wherein said second diaphragm includes spacer means between said diaphragm and said wall to prevent said second diaphragm from sealingly engaging said wall.

6. A combination throttle kicker and deceleration device including a housing having a generally centrally located portion of enlarged diameter including radially extending side walls and a peripheral wall, an annular adapter member positioned in said portion of said housing, a first and second diaphragms interposed between the peripheries of said annular member and said side walls of said housing and sealingly engaging said side wall and said adapter, said adapter having a wall thereby generally dividing said housing and having an opening therein providing communication between the two sides of said wall, means defining a vent passage from the space between said first diaphragm and said wall to the ambient atmosphere exterior of said housing, a vacuum connection in one end of said housing extending to the chamber between said first diaphragm and said housing a chamber between said second diaphragm and said housing, and a shaft mounted for movement in the other end of said housing for connection to a throttle and adapted to be moved by said second diaphragm upon movement away from said wall, said first diaphragm sealingly engaging and controlling said opening in said wall of said adapter, said second diaphragm having an orifice therein including spacer means spacing the orifice from said wall and providing free access of air between said second diaphragm chamber and said wall, spring means yieldingly urging said first diaphragm toward said wall of said adapter, said diaphragms and adapter including aligned passages providing free communication therebetween the end chambers of said housing.

7. The combination set forth in claim 6 wherein each said diaphragm includes annular ribs on the periphery thereof extending axially in both direction, one of said ribs sealingly engaging a side wall of said housing and the other of said ribs extending into a groove in said adapter and sealingly engaging said adapter.

8. The combination set forth in claim 6 wherein each of said diaphragms includes an axially extending annular rib spaced radially inwardly of said first-mentioned rib and sealingly engaging a generally complimentary groove in said adapter.

9. The combination set forth in claim 8 wherein each said diaphragm includes arcuate ribs spaced circumferentially about said diaphragm and extending axially toward said wall of said adapter at a point spaced radially inwardly of said first rib, said second diaphragm spacer means being defined by said arcuate ribs.

10. The combination set forth in claim 9 wherein said adapter includes at least one generally radially opening, said housing having an opening therein communicating with said radial opening.

* * * * *